United States Patent [19]

Pereyra

[11] 4,050,853

[45] Sept. 27, 1977

[54] RAIN-RESPONSIVE CONTROL

[76] Inventor: Armand J. Pereyra, 104 W. C St., Ontario, Calif. 91761

[21] Appl. No.: 632,091

[22] Filed: Nov. 14, 1975

[51] Int. Cl.[2] ..... F04B 49/00; E04H 3/16; H01H 29/00

[52] U.S. Cl. ..... 417/44; 200/61.04; 4/172.12; 250/577; 4/172.15

[58] Field of Search ..... 417/44, 38, 36; 4/172.15, 172.12; 250/577; 200/61.04; 73/17 A, 171, 290; 318/482; 137/392; 340/235

[56] References Cited

U.S. PATENT DOCUMENTS

| | | | |
|---|---|---|---|
| 2,070,617 | 2/1937 | Offott | 73/290 |
| 2,305,090 | 12/1941 | Kronquest | 73/290 |
| 2,361,235 | 10/1944 | Pick | 250/577 |
| 2,710,715 | 6/1955 | Gorham | 318/482 |
| 3,193,637 | 7/1965 | Russell | 200/61.04 |
| 3,333,072 | 7/1967 | Haggard, Jr. | 200/61.04 |
| 3,440,396 | 4/1969 | Greene, Jr. | 200/61.04 |
| 3,810,262 | 5/1974 | Strand | 417/43 |
| 3,848,627 | 11/1974 | Page | 4/172.17 |

OTHER PUBLICATIONS

Norburg et al., entitled "A Rapid-Response Rain Gauge," from J. Phys. E. Instrum. (Aug. 1971).

*Primary Examiner*—William L. Freeh
*Attorney, Agent, or Firm*—Boniard I. Brown

[57] ABSTRACT

A small well fills with rain water and a float in the well rises to interrupt a light beam that falls on a photoelectric cell. The photoelectric cell keeps a control circuit open as long as it is exposed to the light beam and closes the control circuit in the absence of a light beam. The photoelectric cell turns on a blower to inflate a swimming pool cover and simultaneously energizes a lamp bulb to evaporate the water in the small well. When the rain ceases the lamp bulb evaporates the water in the well to lower the float and thereby stop the blower and turn off the lamp bulb. A selector switch has a normal first position to ready the rain-responsive control circuit and has a second position for energizing the blower directly when a person desires to inflate the swimming pool cover for use of the swimming pool in the absence of rain.

8 Claims, 7 Drawing Figures

RAIN-RESPONSIVE CONTROL

BACKGROUND OF THE INVENTION

This invention relates to a control system that responds to rainfall for such purposes as sounding an alarm, closing windows, turning off a sprinkler system etc. More particularly, the invention relates to such a control system of the general type disclosed in the Marquard, U.S. Pat. No. b 2,443,687, the Davis, U.S. Pat. No. 2,640,958 and Kaiser et al, U.S. Pat. No. 2,856,476.

Broadly described a control system of this general type has a small well which falling rain fills and has a control .circuit that responds to the presence of the collected water in the well. Each of the above three patented control systems operates well in theory but in practice each of the control systems is seriously defective.

The Marquard disclosure employs a control switch which is urged to closed position by the force of a spring but is normally held open by an interposed water-soluble wafer. When water enters the small collecting well, the wafer disintegrates to permit the switch to close and energizes an alarm circuit. One serious disadvantage of this arrangement is the necessity of installing a new wafer to reset the control system. Another disadvantage is that the alarm continues to be energized for an indefinite period of time after the rain ceases. A third disadvantage is that repeated exposure of the switch contacts to rainwater causes the contacts to corrode to shorten the service life of the switch.

In the Davis disclosure, an elongated hollow float in a cylindrical well rises to electrically bridge a gap between two switch contacts to close a control circuit in response to rainfall. The lower end of the float is pointed to close a small diameter drain hole at the bottom of the well when no rainwater is in the well. When the rain ceases the well drains to lower the float. To enlarge the drain hole to prevent clogging would make the control system responsive only to a heavy rain and thus defeat the purpose of the control system.

Here again, the switch contacts are repeatedly flooded to build up corrosion. Another serious defect is that the small drain hole in the bottom of the well tends to become clogged with foreign material to make the system inoperative. A further difficulty is that the copper-clad cylindrical float tends to corrode and may stick at the lower drain hole instead of rising. It is also to be noted that the control system is used to raise the top on an automobile in the event of a rainstorm but after the rain ceases the control system does not lower the top to its original position.

In the Kaiser el al disclosure, a small rain-collecting well is mounted on a leaf spring that serves as a switch arm. The weight of the collected water in the well depresses the switch arm to energize an electric alarm circuit. The small well is occupied by a sponge or other-absorbent material which facilitates evaporation of the water in the well when the rainfall ceases.

Here again, repeated flooding of the switch contact induces corrosion that in time makes the control system inoperative. Another difficulty is that the repeated flooding of the absorbent material encourages the growth of fungus that may eventually make the alarm system defective.

SUMMARY OF THE INVENTION

The purpose of the particular embodiment of the invention that is selected for this disclosure is to control the inflation of a swimming pool cover but it is to be understood that various practices of the invention may be directed to various other specific purposes. A swimming pool of the type to which the invention pertains has a cover of flexible translucent sheet material which is normally deflated to lie on the water to collect debris such as wind-borne particles including loose soil, leaves, etc. The periphery of the flexible cover is weighted down, for example, by water filled members that anchor the edges of the cover. When it rains the swimming pool cover is inflated by a motor driven blower to cause the cover to discard the accumulated debris and to shed rain away from the swimming pool. At such time a person desiring to swim may enter the swimming pool by a slit in the inflated cover. In the absence of rain, a person desiring to use the swimming pool energizes the blower to make the swimming pool accessible.

The basic object of the invention is to provide a fully automatic fool-proof rain-sensing control system that may be depended upon for trouble free operation over a long service life. This basic object encompasses more specific objects, namely, (1) to avoid the use of exposed corrodible switch contacts, (2) to avoid employment of a corrodible metal float, and (3) avoid the use of a rain-collecting well that depends on a minute drain hole that tends to become clogged by foreign material.

To attain the above objects, the invention employs a photoelectric cell as a switch in a control system and employs a float of organic material in a water-collecting well that rises in the well to cut off a light beam on the photoelectric cell. The photoelectric cell keeps the control circuit open as long as it is subject to the light beam but closes the control circuit when the light beam is interrupted. Instead of providing a small drain hole to empty the well when the rain ceases, the invention provides a suitable electrically energized heating means to empty the well by evaporation.

Whenever the control system responds to rain by energizing the blower to inflate the swimming pool cover, the control system also energizes the heating means that evaporates water in the well. The control system will not inflate the swimming pool cover unless the rate at which rain is directed into the well exceeds the rate at which heating means evaporates the water in the well. Accordingly the rate of evaporation is one factor that controls the sensitivity of the control system to rainfall. Thus the higher the rate of evaporation, the higher the rate of rainfall that is necessary to fill the cup and elevate the float. The time required for the well to empty to turn off the blower when the rain ceases also depends upon the rate of evaporation by the heating means.

The sensitivity of the control system may also be varied by varying the rate at which a rain-collecting funnel directs rain water into the collecting well. For a given rate of rainfall, the greater the area of the funnel the higher the rate at which the water flows into the well. It is within the skill expected in this the art to select (1) the volumetric capacity of the well, (2) the area of the funnel, and (3) the heat output of the evaporating means to establish a desired threshold of rainfall to which the control system responds and to cause the float to be lowered by evaporation within a reasonable length of time after a rain ceases.

Although any suitable electrically energized heating means may be employed, a feature of the preferred practice of the invention is the employment of an inexpensive light bulb for this purpose. A conventional 100 watt 110 volt lamp bulb in a 110 volt circuit provides a satisfactory rate of evaporation for a well of a relatively small given volumetric capacity. For example, a 100 watt 110 volt lamp bulb in close proximity to a metal well of ¾ inch inside diameter and a depth of ½ inch will evaporate the water therein at a rate to lower the float to terminate the control cycle within approximately ½ hour after a rain stops.

A further object of the invention is to provide a control system that will not only inflate the swimming pool cover automatically in the event of a rain but will also permit the swimming pool cover to be inflated in the absence of rain to make the swimming pool accessible for swimming. This object is accomplished by providing the control system with a selector switch having two alternate positions. At the normal first position of the selector switch, the control system is set for automatic operation in the event of a rain. At its second position, the selector switch energizes the blower alone. Thus when it is desirable to use the swimming pool in the absence of a rain, the selector switch is moved from its normal first position to its second position to inflate the swimming pool cover and to keep the cover inflated. Returning the selector switch to its normal first position not only stops the blower but also sets the system to respond automatically to rainfall.

The various features and advantages of the invention may be understood from the following detailed description and the accompanying drawings.

BRIEF DESCRIPTION OF THE DRAWING

In the drawings, which are to be regarded as merely illustrative.

DESCRIPTION OF THE SELECTED EMBODIMENT OF THE INVENTION

Figure 1:
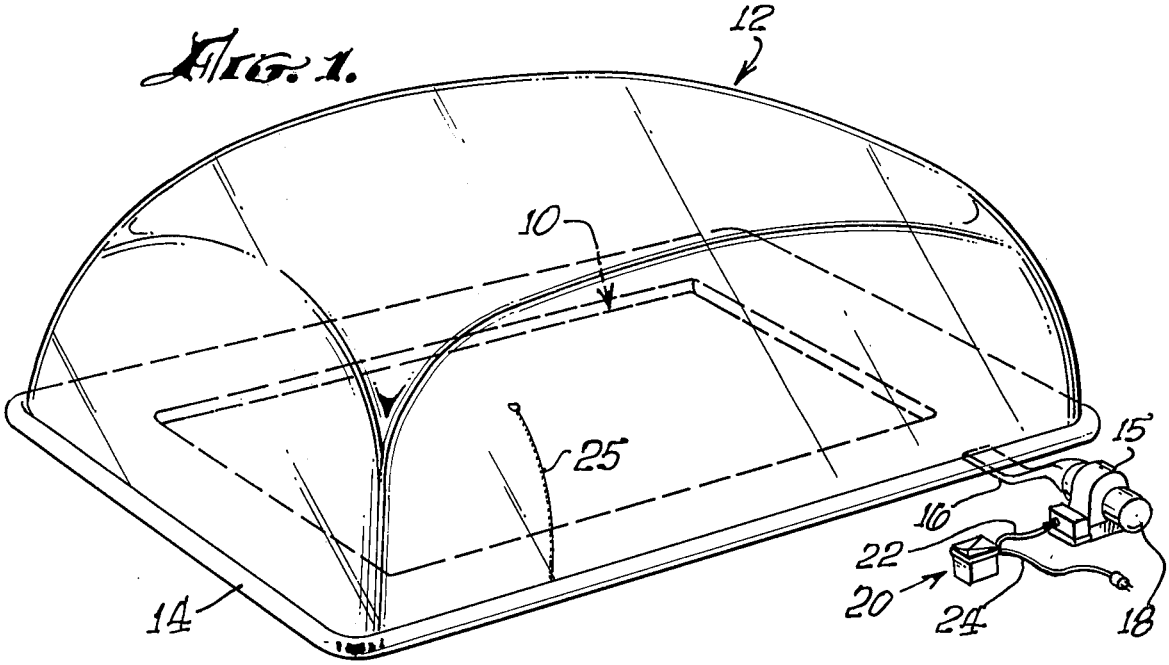
FIG. 1 is a somewhat diagrammatic perspective view showing a swimming pool with a swimming pool cover inflated by a motor-driven blower.

FIG. 1 shows a swimming pool 10 protected by an inflated cover 12 of flexible sheet material that is weighted down along its periphery by flexible tubular means 14 that is filled with water. The cover 12 is inflatable by a blower 15 that is connected to the cover by a flattened sheet metal duct 16 that passes under the water-filled tubular means 14 and is driven by a suitable electric motor 18. A rain-sensing unit 20 embodying the preferred practice of the invention is connected to the motor by an electric cable 22 and is provided with a second electric cable 24 that is plugged into the domestic electric supply circuit. The cover 12 is provided with a zippered entrance slit 25 for access to the pool while the cover is inflated.

Figure 2:
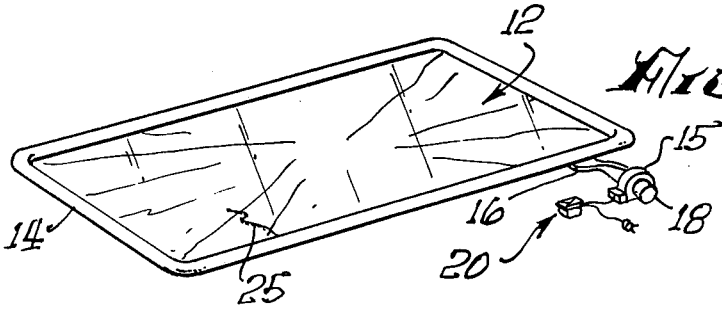
FIG. 2 is a similar view showing the cover deflated and lying flat on the surface of the water of the swimming pool.

FIG. 2 shows the cover 12 in its normal deflated state at which the flexible sheet material rests on the water of the swimming pool to collect foreign materials including wind-blown objects such as leaves and particles of dirt. When the swimming pool cover is inflated it discards the accumulated debris and also sheds falling rain away from the swimming pool.

Figure 3:
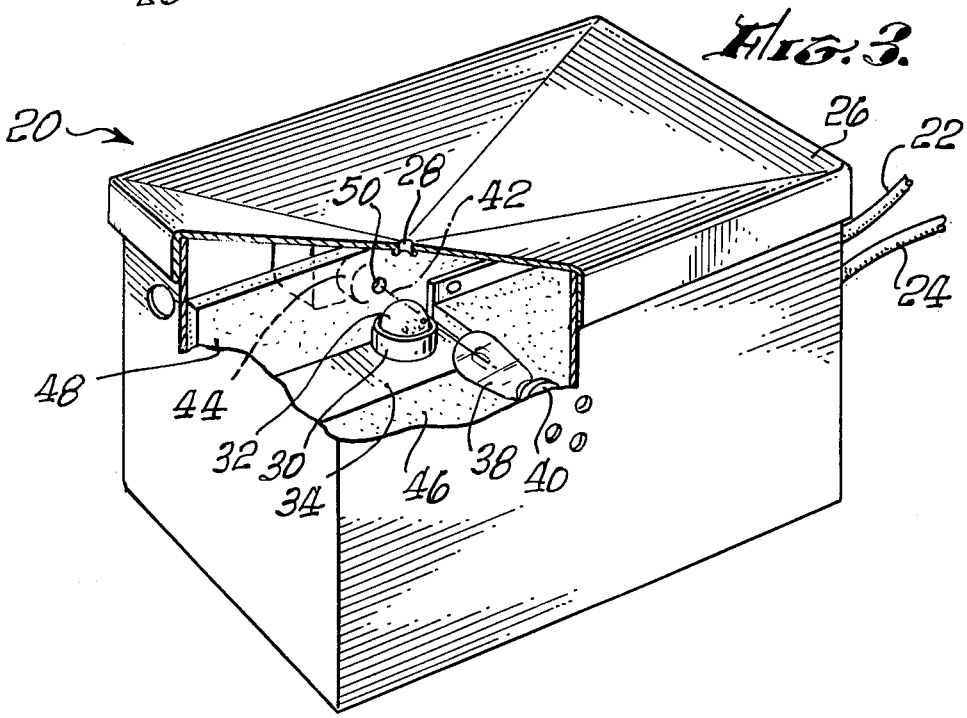
FIG. 3 is an enlarged perspective view of the presently preferred embodiment of the control unit of the system, a portion of the unit being broken away to review hidden parts.
Figure 4:
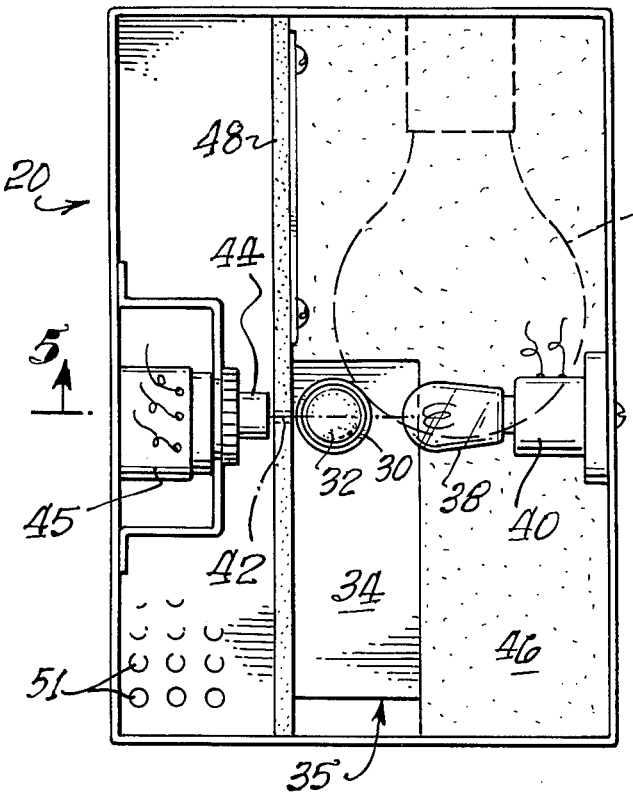
FIG. 4 is a top plan view of the control unit with the cover of the control unit removed.
Figure 6:
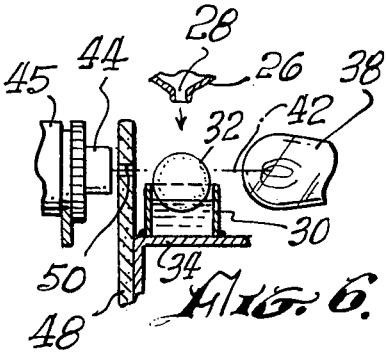
FIG. 6 is a fragmentary view similar to FIG. 5 with the float elevated to cut off the light beam that normally illuminates the photoelectric cell.

As shown in FIGS. 3 and 6 the control unit 20 may be in the form of a box with a removable cover 26 that forms a rain-receiving funnel of the configuration of an inverted pyramid. The bottom of the funnel has an outlet 28 that discharges the collected water into a small cylindrical metal well 30 that confines a ball-shaped float 32 of nonmetallic material, for example, a float made of cork.

The well 30 is mounted on the metal top wall 34 of an open-bottomed heater housing 35 that encloses a suitable electrically actuated heater 36. In this particular embodiment of the invention the heater 36 is a conventional 100 watt lamp bulb in a 110 volt circuit. Above the heater housing 35, a small lamp 38 removably mounted in a socket 40 provides a beam of light along an axis 42 that lies just above the well 30 and is directed onto the lens 44 of a photoelectric cell 45 that functions as a light-sensitive switch in a control circuit for energizing the blower 15. In the construction shown in the drawings, a layer 46 of asbestos on the top of the heater housing 35 shields the lamp 38 and socket 40 from excessive heat from the 100 watt lamp and the photoelectric cell 45 is protected from excessive heat by an upright asbestos panel 48 that has a small bore 50 to clear the light beam.

A feature of the preferred practice of the invention is that the small lamp 38 is a conventional 10 watt lamp that is designed for a 220 volt circuit but is employed in a 110 volt circuit so that its output is reduced to 5 amps. The high voltage lamp in a low voltage circuit has a surprisingly long service life. The bottom wall of the control unit has numerous small openings 51 for ventilation.

In this particular embodiment of the invention, the funnel formed by the lid 26 is 5 inches wide and 7⅝ inches long thus providing a total rain-catching area of approximately 40 square inches. The well 30 has an inside diameter of ¾ inch and is ½ inch deep but of course the effective volume of the well is reduced somewhat by the presence of the float 32.

The described arrangement makes the control unit 20 responsive to rainfall of a desirable minimum rate and after a rain ceases the heater lamp 36 evaporates the water in the well at a rate to energize the photoelectric cell in aproximately one half hour to stop the blower 15. If the rain pauses for a time period of 10 to 20 minutes, the blower remains energized to keep the swimming pool cover inflated so that short pauses in a rainfall do not cause the control circuit to turn on and off intermittently. The diameter of the ball 32 when it is wet may be approximately 1/16 less than the inside diameter of the well 30 to give the ball a radial clearance of 1/32 inch to permit the ball to rise and fall freely with no tendency for the ball to stick.

Figure 7:
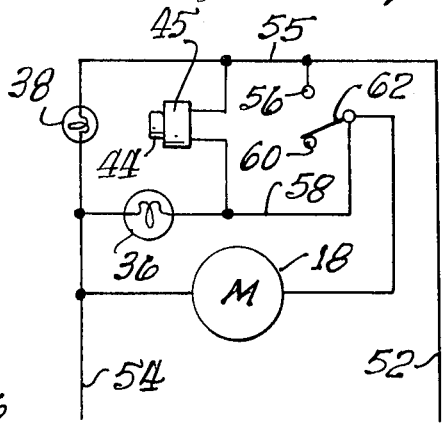
FIG. 7 is a wiring diagram of the control system.
Figure 5:
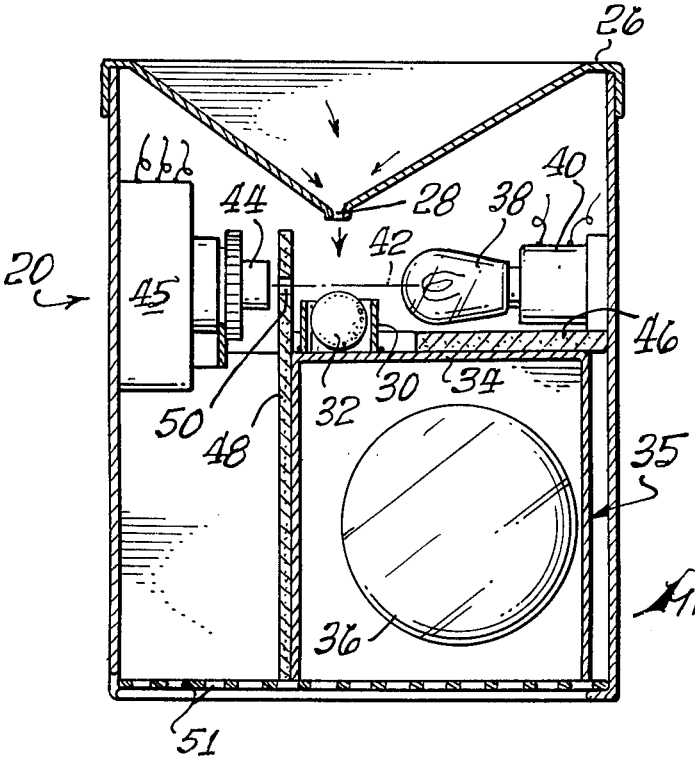
FIG. 5 is a section of the control unit taken as indicated by the line 5—5 of FIG. 4, the viewing showing the float in the well at its lowermost position.

FIG. 7 is a wiring diagram of the presently preferred control circuit for the motor 18. Two leads 52 and 54 in the control circuit are connected to a 110 volt domestic source of 110 voltage current. One side of the small lamp 38 is connected to the lead 54 and the other side is connected to the lead 52 by a wire 55. One side of the photoelectric cell 45 is connected to the wire 55 and a contact 56 of a normally open switch 62 is also connected to the wire 55. One side of the heater lamp 36 is connected to the lead 54 and the other side is connected by a wire 58 to the second side of the photoelectric cell 55 and to the switch arm of the normally open switch 62. The switch arm of the normally open switch is connected to one side of the motor 18 and the second side of the motor is connected to the lead 54.

The normally open switch 62 functions as a selector switch wherein as shown in FIG. 7 the switch arm 62 has a first normal open position against a stop 60 and may be manually moved to a second alternate position against the contact 56. At the normal first position of the switch arm shown in the diagram the switch 62 in effect readies the control unit 20 to energize the motor 18 in response to falling rain. The small lamp 38 that controls the photoelectric cell is continously energized to keep the control circuit open to prevent energization of both the motor 18 and the heater lamp 36. In the event that rain occurs to lift the float to intercept the light beam the photoelectric cell energizes both the motor 18 and the heater lamp 36. When rain ceases for as long as approximately one half an hour the heater lamp 36 evaporates the water sufficiently in the well 30 to cause the float to drop far enough to permit the light beam to illuminate the photoelectric cell with consequent opening of the control circuit to de-energize both the motor 18 and the heater lamp 36.

If it is desired to use the swimming pool in the absence of rainfall, the arm of the selector switch 62 is swung to its closed position against the contact 56 with consequent direct energization of the motor 18 to inflate the swimming pool cover and keep the swimming pool cover inflated. When it is no longer desired to use the swimming pool, the arm 62 of the selector switch is returned to its normal open position against the stop 60 to reset the control system for response to falling rain. The selector switch 62 may be at any convenient location. For example the selector switch may be mounted on the exterior of the control unit 20 or may be located at a distance from the unit for remote control of the unit.

My description in specific detail of the presently preferred practice of the invention will suggest various changes, substitutions, and other departures from my disclosure within the spirit and scope of the appended claims.

I claim:

1. In a control system to respond to rainfall, the combination of:

a well positioned and arranged to receive water from falling rain;

a control circuit;

a responsive switch to operate the control circuit in response to rise in the water in the well; and heating means to evaporate the water in the well at a given rate, said given rate being less than the rate that water enters the well when rain falls at a selected minimum rate so that the well remains full as long as the rain falls at a rate above said selected rate and the water level drops in the well to operate said switch means when the rain ceases.

2. A combination as set forth in claim 1 in which the control circuit includes electrically actuated means to inflate a swimming pool cover;

and in which the control circuit includes a selector switch having a first normal position and a second position, the selector switch at said first position permitting said responsive switch to energize both the inflating means and the heating means when the responsive switch operates said control circuit, said selector switch at its second position energizing the inflating means independently of the heating means, whereby the selector switch may be moved to its first position for operation of the inflating means in response to falling rain and, in the absence of rain, may be moved to its second position to inflate the swimming pool cover independently of both the responsive switch and the heating means.

3. A combination as set forth in claim 1 in which said heating means is a light bulb.

4. A combination as set forth in claim 1 which includes a float in the well to rise and fall with the water level in the well;

and in which said responsive switch responds to the rise and fall of the float.

5. A combination as set forth in claim 3, which includes means to create a light beam; in which said responsive switch is responsive to the light beam;

and in which the float intercepts the light beam when the water level rises in the well.

6. A combination as set forth in claim 5 in which the control circuit includes electrical actuated means to inflate a swimming pool cover in response to falling rain.

7. A combination as set forth in claim 6 in which said means to create the light beam is a lamp designed to operate at 10 watt output in a 220 volt circuit and the lamp is energized by substantially 110 volts to operate with a 5 watt output for an extremely long service life.

8. The combination of: a control circuit, means in the control circuit to inflate a cover for a swimming pool, means for sensing falling rain and energizing said inflating means in response to falling rain, a selector switch having a first position and a second position, said selector switch at its first position permitting the responsive switch to energize inflating means in the event of falling rain, said selector switch at its second position energizing the inflating means independently of the responsive switch, whereby with the selector switch at its first position a person desiring to use the swimming pool in the absence of rain may turn the selector switch to its second position to inflate the swimming pool cover and may later return the selector switch to its first position to deflate the swimming pool cover and to reset the control circuit for operating the inflating means in response to falling rain.

* * * * *